US008136977B2

(12) United States Patent
Chiang et al.

(10) Patent No.: US 8,136,977 B2
(45) Date of Patent: Mar. 20, 2012

(54) LIGHTING APPARATUS

(75) Inventors: Jen-Ta Chiang, Taipei (TW); Chia-Hao Liang, Taipei (TW)

(73) Assignee: Everlight Electronics Co., Ltd., New Taipei (TW)

( * ) Notice: Subject to any disclaimer, the term of this patent is extended or adjusted under 35 U.S.C. 154(b) by 261 days.

(21) Appl. No.: 12/608,997

(22) Filed: Oct. 29, 2009

(65) Prior Publication Data

US 2010/0110703 A1 May 6, 2010

(30) Foreign Application Priority Data

Oct. 30, 2008 (TW) ..... 97141851 A

(51) Int. Cl.
*F21V 21/00* (2006.01)

(52) U.S. Cl. ..... 362/631; 362/630; 362/391

(58) Field of Classification Search ..... 362/630–631, 362/392

See application file for complete search history.

(56) References Cited

U.S. PATENT DOCUMENTS

| | | | | |
|---|---|---|---|---|
| 7,887,218 | B2 * | 2/2011 | Wang | 362/240 |
| 7,931,391 | B2 * | 4/2011 | Lin et al. | 362/457 |
| 2003/0016312 | A1 * | 1/2003 | Park et al. | 349/58 |
| 2003/0117807 | A1 * | 6/2003 | Hur et al. | 362/457 |
| 2008/0049161 | A1 | 2/2008 | Kim et al. | |

FOREIGN PATENT DOCUMENTS

| | | |
|---|---|---|
| CN | 2874262 | 2/2007 |
| TW | M298683 | 10/2006 |
| TW | 338943 | 8/2008 |

* cited by examiner

*Primary Examiner* — Robert May
(74) *Attorney, Agent, or Firm* — Jianq Chyun IP Office

(57) ABSTRACT

A lighting apparatus including a base, a light emitting unit, and a conducting wire is provided. The base includes a bottom board and a side frame. The bottom board has a first surface, a second surface, a recess, a first through hole, and a second through hole. The recess is located at the second surface. The first through hole and the second through hole are located at the recess and pass through the bottom board. The side frame is disposed on the first surface. The light emitting unit is disposed on the first surface. An end of the conducting wire is electrically connected to the light emitting unit. The conducting wire extends from the first surface to the recess through the first through hole, and extends from the recess to an outer side of the first surface through the second through hole.

9 Claims, 4 Drawing Sheets

LIGHTING APPARATUS

CROSS-REFERENCE TO RELATED APPLICATION

This application claims the priority benefit of Taiwan application serial no. 97141851, filed on Oct. 30, 2008. The entirety of the above-mentioned patent application is hereby incorporated by reference herein and made a part of specification.

BACKGROUND OF THE INVENTION

1. Field of the Invention

The present invention relates to a lighting apparatus.

2. Description of Related Art

Along with the advancement of semiconductor technology, light-emitting diodes (LEDs) have achieved a higher power, emitted stronger light. Moreover, the LEDs feature various advantages, such as power saving, long service life, environmental protection, quick start-up, and small volume. Therefore, the LEDs are applied in more and more fields, such as illumination, traffic lights, displays, optical mice, and LED string lamps.

Currently, most outdoor advertisement boards use the LED string lamps as their lighting apparatus. Since an outdoor lighting apparatus must have better weatherability and waterproofness, the conventional technology is to fill the internal space of the housing of a lighting apparatus with encapsulant, so as to wrap the LED. However, in order to fill the internal space of the whole housing, a lot of encapsulant will be consumed, so it is difficult to reduce the cost of the LED string lamp, and the LED string lamp becomes heavier. Furthermore, many air bubbles will appear when the internal surface of the housing is filled by a lot of encapsulant, thereby degrading the yield of the LED string lamp. Furthermore, due to high consumption of the encapsulant, a long time period is needed before the curing of the encapsulant, resulting in difficulty in improving the production efficiency.

In addition, since the LEDs in the lighting apparatus and an external power are connected by a conducting wire, which is connected to the LEDs merely through solder joints by means of soldering, under the pulling force from the outside, the conducting wire will easily drop off from the solder joints due to the insufficient joint force, with the result that the LED string lamp cannot operate normally. In another aspect, during a manufacturing process of the conventional LED string lamp, when the encapsulant is filled into the internal space of the housing, a circuit board carrying the LEDs may float on the encapsulant, and then the LEDs cannot be completely encapsulated by the encapsulant, which degrades the yield of the LED string lamp.

SUMMARY OF THE INVENTION

Accordingly, the present invention is directed to a lighting apparatus, which has a low cost and a high manufacturing yield.

A lighting apparatus is provided in one embodiment of the present invention. The lighting apparatus includes a base, a light emitting unit, and a conducting wire. The base includes a bottom board and a side frame. The bottom board has a first surface, a second surface, a recess, a first through hole, and a second through hole. The second surface is opposite to the first surface. The recess is located at the second surface, and has a first end and a second end opposite to the first end. The first through hole is located at the first end of the recess and passes through the bottom board. The second through hole is located at the second end of the recess and passes through the bottom board. The side frame is disposed on the first surface. The first through hole and the second through hole are located inside and outside the side frame respectively. The light emitting unit is disposed on the first surface and inside the side frame. An end of the conducting wire is electrically connected to the light emitting unit. The conducting wire extends from the first surface to the first end of the recess through the first through hole, extends from the first end to the second end, and extends from the second end to an outer side of the first surface through the second through hole.

In one embodiment of the present invention, the lighting apparatus further includes an encapsulant filled in the recess and encapsulating a part of the conducting wire in the recess.

In one embodiment of the present invention, the bottom board further has a hook, which is located in the recess and at one side of the conducting wire. A head of the hook is located at a top of the recess to hook the conducting wire.

In one embodiment of the present invention, the light emitting unit includes a circuit board and an LED. The circuit board is disposed on the first surface and inside the side frame. The end of the conducting wire is connected to the circuit board. The LED is disposed on the circuit board.

In one embodiment of the present invention, the lighting apparatus further includes a light transmissive lamp shade disposed on the side frame and covering the light emitting unit. The light transmissive lamp shade has a light exit surface facing away from the light emitting unit. The light exit surface has a plurality of optical structures for changing an emergence direction of light emitted from the light emitting unit. The side frame has a first fitting portion located at an end of the side frame far away from the bottom board. The light transmissive lamp shade has a second fitting portion located at an end of the light transmissive lamp shade far away from the light exit surface. The first fitting portion and the second fitting portion fit with each other. The first fitting portion is, for example, an annular protrusion, and the second fitting portion is, for example, an annular depression.

In one embodiment of the present invention, the first fitting portion is, for example, an annular depression, and the second fitting portion is, for example, an annular protrusion.

In one embodiment of the present invention, the lighting apparatus further includes an encapsulant disposed between the first fitting portion and the second fitting portion.

A lighting apparatus is provided in another embodiment of the present invention. The lighting apparatus includes a circuit board, a light-emitting element, a base, and a locking element. The circuit board has a first surface and a second surface opposite to the first surface, and has a through hole communicating the first surface and the second surface. The light-emitting element is disposed on the first surface. The base carries the circuit board, and the second surface rests on the base. The locking element includes a plurality of resilient hooks, and each of the resilient hooks includes a resilient support and a hook head. The resilient support passes through the through hole, and one end of the resilient support is connected to the base. The hook head is connected to the other end of the resilient support, and the hook head hooks the first surface of the circuit board.

In one embodiment of the present invention, the resilient supports of the resilient hooks are suitable to be bent, such that the hook heads move toward a geometric center of the hook heads. Each of the hook heads has a guide surface, which inclines with respect to the first surface and faces away from the geometric centers of the hook heads.

In one embodiment of the present invention, the light-emitting element is, for example, an LED.

In one embodiment of the present invention, the base includes a bottom board and a side frame. The bottom board carries the circuit board, and the locking element is connected to the bottom board. The side frame is located on the bottom board, and the circuit board and the light-emitting element are inside the side frame.

In the lighting apparatus according to the embodiments of the present invention, the conducting wire extends to the recess from above the bottom board of the base to the recess through the first through hole, and extends from the recess to above the bottom board through the second through hole. When the conducting wire is pulled by an external force, the recess can bear the pulling force from the conducting wire, so as to prevent the conducting wire from dropping off form the light emitting unit. Thus, even if the conducting wire is pulled by an external force, the lighting apparatus may still operate normally. In the lighting apparatus according to the embodiments of the present invention, since the circuit board may be assembled onto the base easily by using the locking element, the circuit board will not float on the encapsulant when filling the encapsulant. In such a way, the lighting apparatus has a high manufacturing yield and efficiency.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
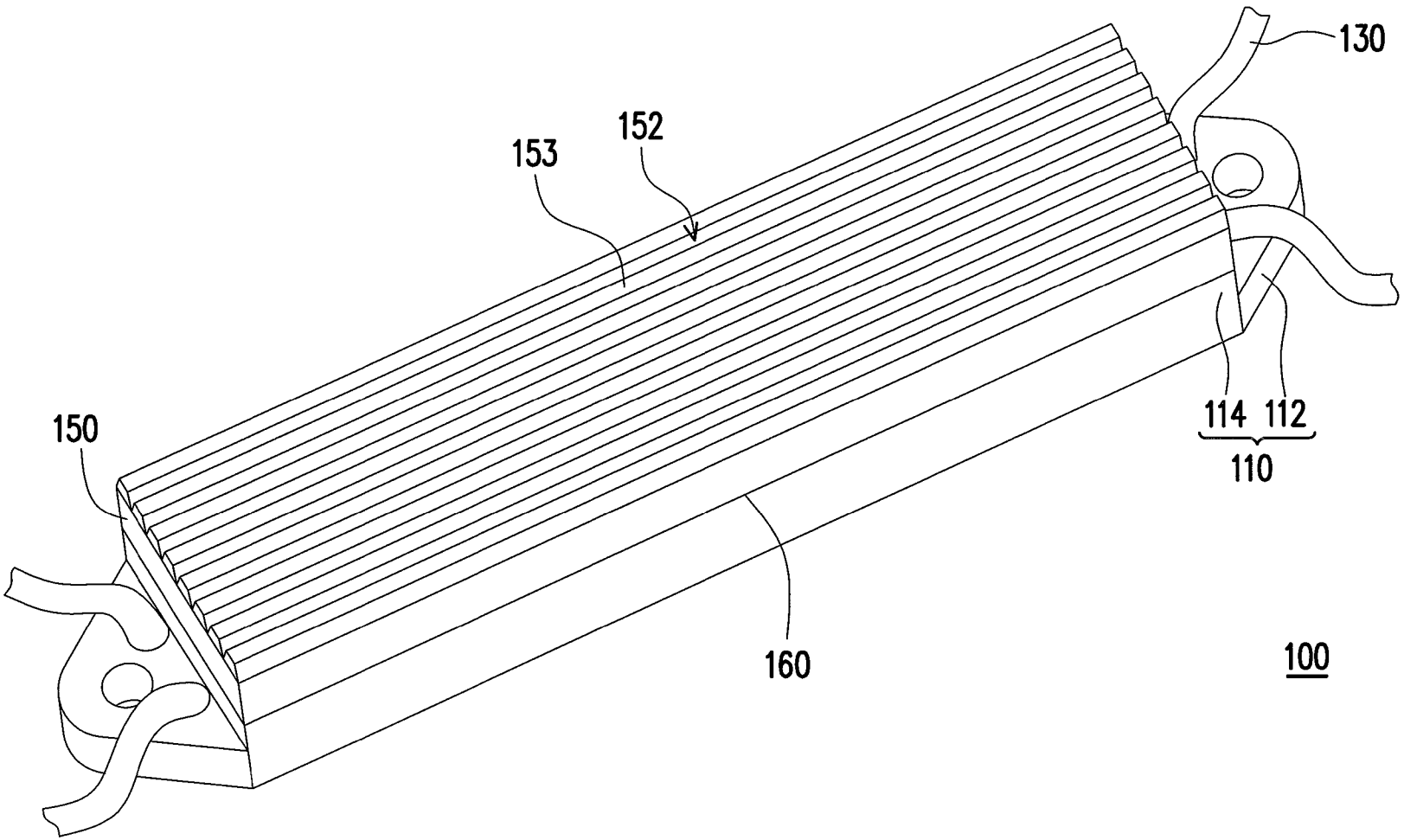
FIG. 1A is a three-dimensional view of the lighting apparatus according to one embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
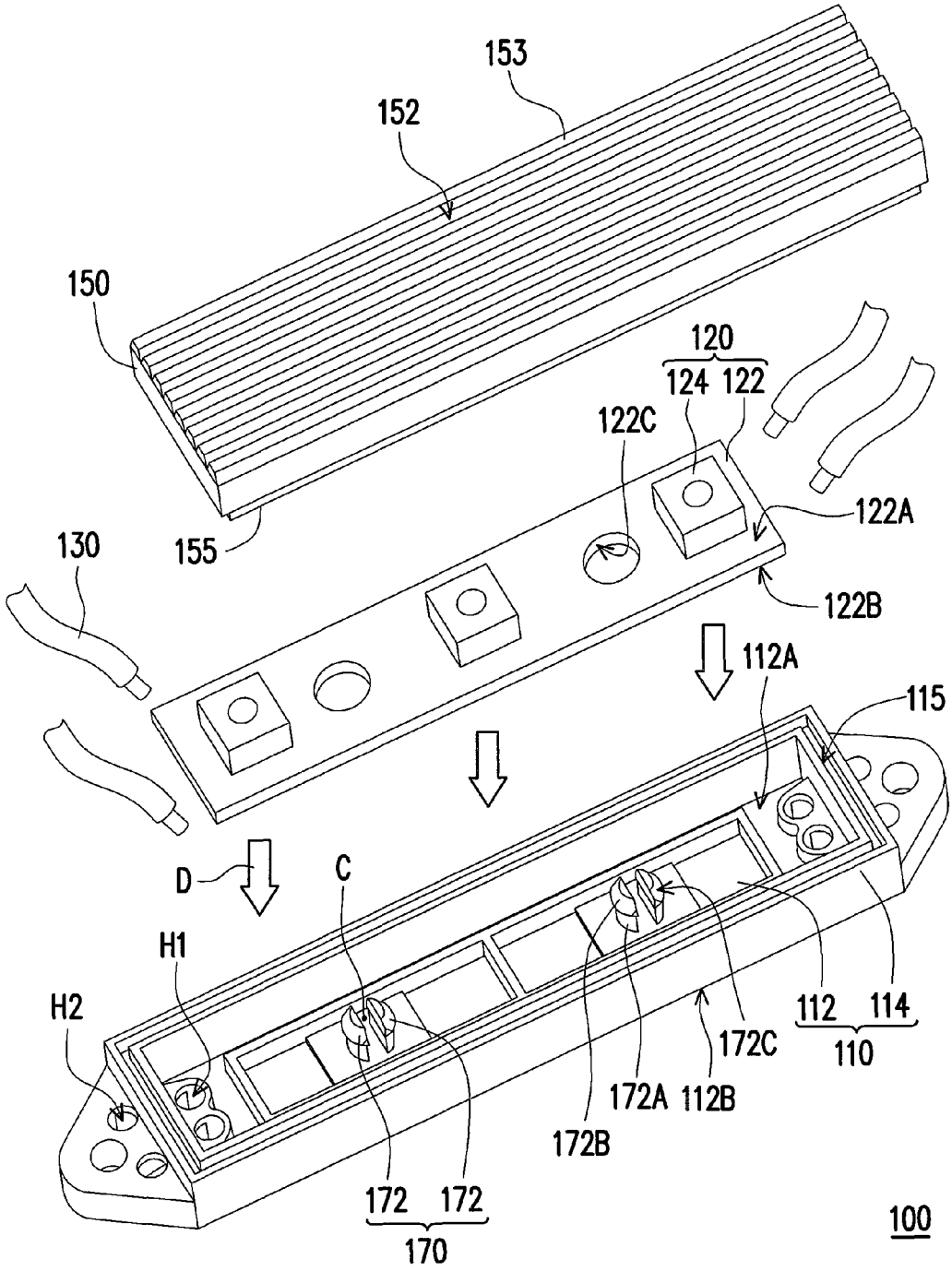
FIG. 1B is an exploded view of the lighting apparatus of FIG. 1A.
Figure 2A:
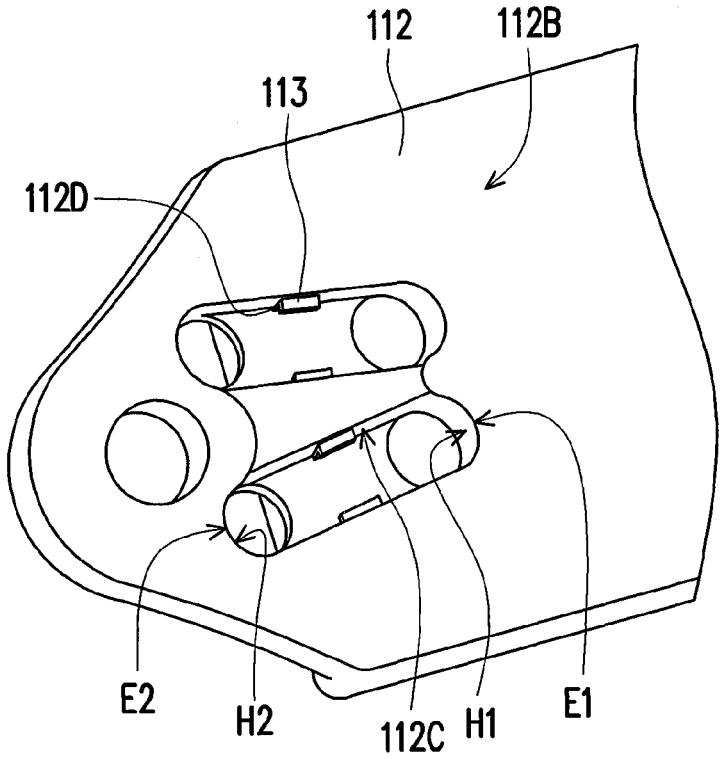
FIG. 2A is a three-dimensional view of one end of the base of FIG. 1A before filling the encapsulant.
Figure 2B:
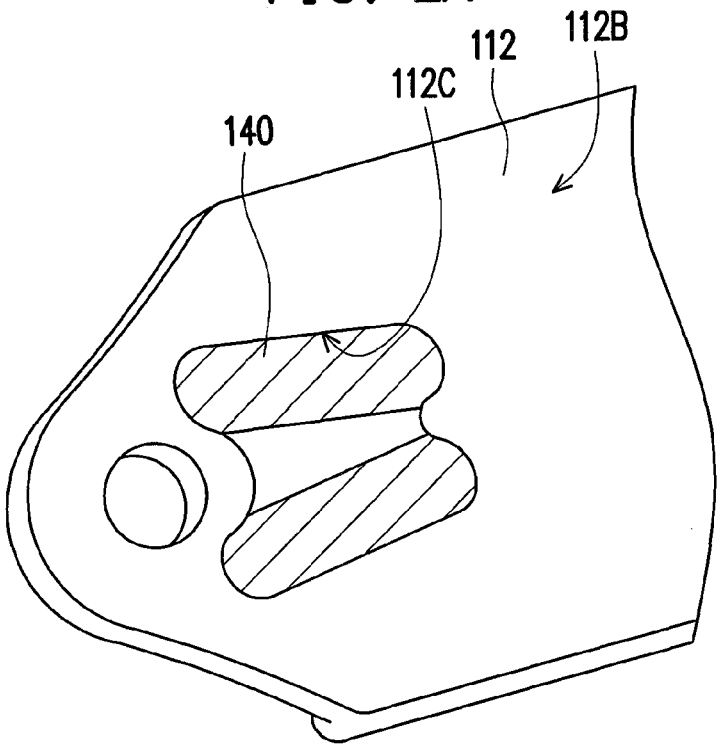
FIG. 2B is a three-dimensional view of one end of the base of FIG. 1A after filling the encapsulant.

FIG. 1A is a three-dimensional view of a lighting apparatus according to one embodiment of the present invention, FIG. 1B is an exploded view of the lighting apparatus of FIG. 1A, FIG. 2A is a three-dimensional view of one end of the base of FIG. 1A before filling the encapsulant, and FIG. 2B is a three-dimensional view of one end of the base in FIG. 1A after filling the encapsulant. Referring to FIGS. 1A, 1B, and 2A, the lighting apparatus 100 according to this embodiment includes a base 110, a light emitting unit 120, and a plurality of conducting wires 130. The base 110 includes a bottom board 112 and a side frame 114. The bottom board 112 has a first surface 112A, a second surface 112B, a plurality of recesses 112C (as shown in FIG. 2A), a plurality of first through holes H1, and a plurality of second through holes H2. The second surface 112B is opposite to the first surface 112A. The recesses 112C are located on the second surface 112B, and have a first end E1 and a second end E2 opposite to the first end E1. The first through holes H1 are located at the first end E1 of the recesses 112C, and pass through the bottom board 112. The second through holes H2 are located at the second end E2 of the recess 112C, and pass through the bottom board 112. The side frame 114 is disposed on the first surface 112A, and the first through holes H1 and the second through holes H2 are respectively inside and outside the side frame 114.

The light emitting unit 120 is disposed on the first surface 112A and within the side frame 114. In this embodiment, the light emitting unit 120 includes a circuit board 122 and a plurality of LEDs 124. The circuit board 122 is disposed on the first surface 112A and inside the side frame 114, and the LED 124 is disposed on the circuit board 122. One end of the conducting wires 130 is electrically connected to the light emitting unit 120. In this embodiment, this end of the conducting wires 130 is connected to the circuit board 122. More specifically, the circuit board 122 has a third surface 122A and a fourth surface 122B opposite to the third surface 122A, this end of the conducting wire 130 may be connected to the fourth surface 122B of the circuit board 122 by soldering, and the LED 124 is disposed on the third surface 122A of the circuit board 122. However, in other embodiments, this end of the conducting wires 130 may also be connected to the third surface 122A of the circuit board 122. It should be noted that, in other embodiments, the LED 124 may also be replaced with other suitable light-emitting elements.

The conducting wire 130 extends from the first surface 112A to the first end E1 of the recess 112C through the first through hole H1 (as shown in FIG. 2A), extends from the first end E1 to the second end E2, and extends from the second end E2 to the outer side of the first surface 112A through the second through hole H2. In this embodiment, the lighting apparatus 100 further includes an encapsulant 140 (as shown in FIG. 2B), which is filled into the recess 112C, and encapsulates the part of the conducting wire 130 in the recess 112C. In addition, the bottom board 112 further includes two hooks 112D, which are located in the recess 112C and at the two opposite sides of the conducting wire 130. Hook heads 113 of the hooks 112D are located at the top of the recess 112C to hook the conducting wire 130.

In the lighting apparatus 100 according to this embodiment, the conducting wires 130 extend from above the first surface 112A of the bottom board 112 to the recesses 112C at the second surface 112B through the first through holes H1, and from the recesses 112C to above the first surface 112A through the second through holes H2. When the conducting wires 130 are pulled by an external force, the recesses 112C can bear the pulling force of the conducting wire 130, so as to prevent the junctions of the conducting wires 130 and the circuit board 122 from being under stress directly and dropping off. Thus, even if the conducting wires 130 are pulled by an external force, the lighting apparatus 100 may still operate normally. Furthermore, the hooks 112D are helpful for fixing the position of the conducting wires 130. Therefore, when the conducting wires 130 are pulled by an external force, the tensile force on the conducting wires 130 is less likely to be transferred to the junctions between the conducting wires 130 and the circuit board 122.

In this embodiment, the lighting apparatus 100 further includes a lamp shade 150 disposed on the side frame 114 and covering the light emitting unit 120. The light transmissive lamp shade 150 has a light exit surface 152 facing away from the light emitting unit 120, and the light exit surface 152 has a plurality of optical structures 153 for changing the emergence direction of light emitted from the light emitting unit 120. More specifically, the optical structures 153 may be, for example, strip-shaped protrusions. However, in other embodiments, the optical structures 153 may also be spot-shaped protrusions, bump-shaped protrusions, spot-shaped recesses, bump-shaped recesses, strip-shaped recesses, or optical structures of other forms. Thus, when the user has different requirements for the light shapes of the lighting apparatus 100, the lamp shade 150 having different optical structures 153 may be changed to meet the requirements, and it is unnecessary to change the light emitting unit 120 or the LED 124.

In this embodiment, the side frame 114 has a first fitting portion 115 located at one end of the side frame 114 far away from the bottom board 112, and the light transmissive lamp shade 150 has a second fitting portion 155 located at one end of the light transmissive lamp shade 150 far away from the light exit surface 152. The first fitting portion 115 and the second fitting portion 155 fit with each other. More specifically, for example, the first fitting portion 115 is an annular depression, the second fitting portion 155 is an annular protrusion, and the second fitting portion 155 is embedded into the first fitting portion 115. However, in other embodiments, the first fitting portion 115 may also be an annular protrusion, and the second fitting portion 155 may also be an annular depression. In this embodiment, the lighting apparatus 100 further includes an encapsulant 160 (as shown in FIG. 1A) disposed between the first fitting portion 115 and the second fitting portion 155.

The lighting apparatus 100 according to this embodiment has better weatherability and waterproofness just because of the encapsulant 140 disposed in the recesses 112C and the encapsulant 160 disposed between the first fitting portion 115 and the second fitting portion 155, and it is unnecessary to fill the whole internal space formed by the base 110 and the light transmissive lamp shade 150 with the encapsulant. In such a manner, the lighting apparatus 100 can have a light weight and a low cost, and the yield reduction caused by air bubbles in the encapsulant filled in the internal space is prevented.

Figure 3:
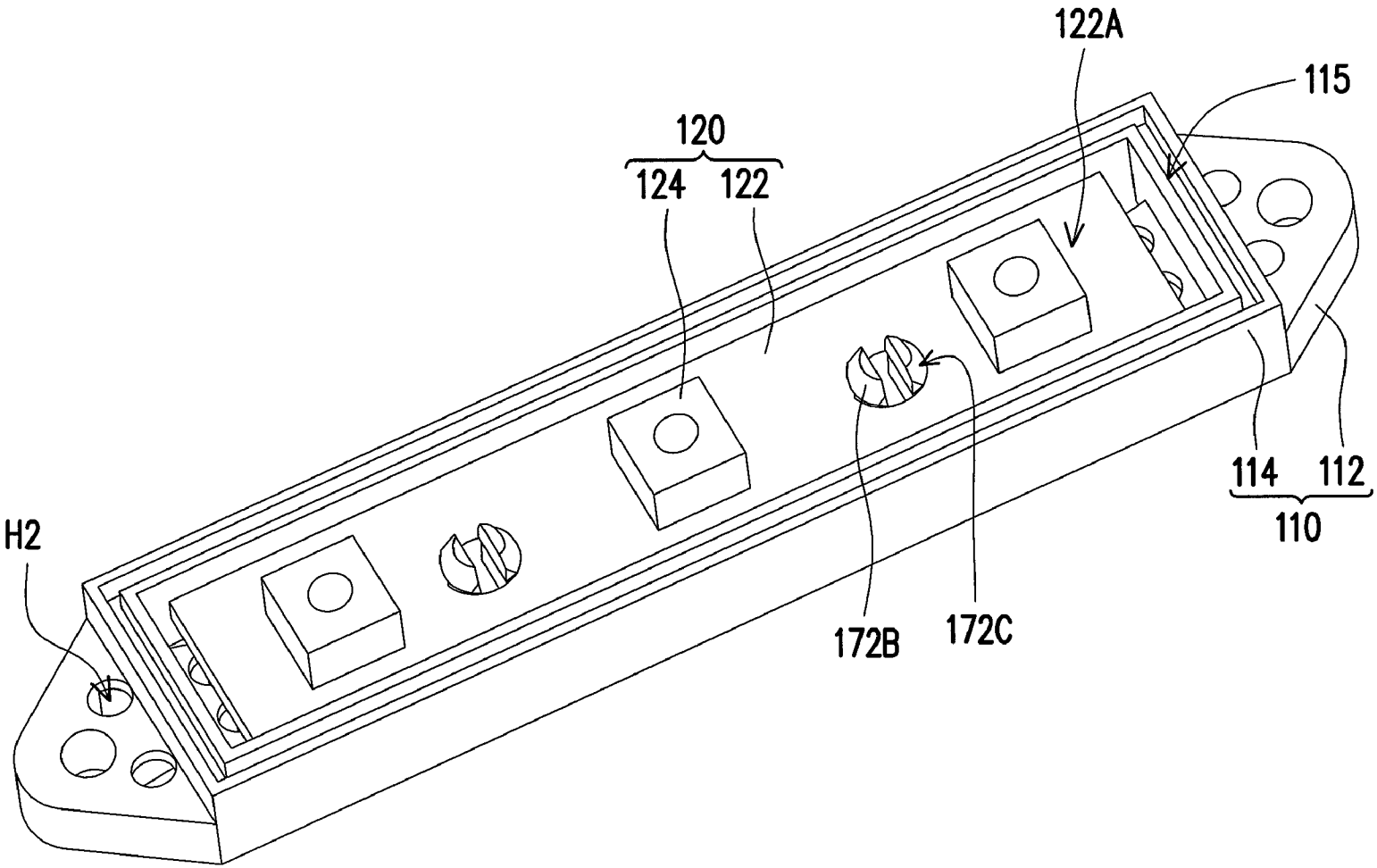
FIG. 3 is a schematic three-dimensional view of the circuit board assembled to the base of FIG. 1B.

In this embodiment, the circuit board 122 has a plurality of through holes 122C communicating the third surface 122A and the fourth surface 122B. Furthermore, the base 110 carries the circuit board 122, and the fourth surface 122B of the circuit board 122 rests on the base 110. In this embodiment, the lighting apparatus 100 further includes a plurality of locking elements 170, and each of the locking elements 170 includes a plurality of resilient hooks 172. Each of the resilient hooks 172 includes a resilient support 172A and a hook head 172B. The resilient supports 172A pass through the through holes 122C. In other words, the locking elements 170 pass through the through holes 122C respectively. Furthermore, one end of the resilient support 172A is connected to the base 110. More specifically, one end of the resilient support 172A may be connected to the bottom board 112 of the base 110. The hook head 172B is connected to the other end of the resilient support 172A, and the hook head 172B is suitable for hooking the third surface 122A of the circuit board 122, as shown in FIG. 3.

In this embodiment, the resilient supports 172A of the resilient hooks 172 are suitable to be bent, such that the hook heads 172B move toward a geometric center C of the hook heads 172B (as shown in FIG. 1B). Furthermore, in this embodiment, each of the hook heads 172B has a guide surface 172C, which inclines with respect to the third surface 122A of the circuit board 122, and faces away from the geometric center C of the hook heads 172B. In order to assemble the circuit board 122 onto the base 110, it is only necessary to press the circuit board 122 toward the base 110 along a direction D, so that the edge of the through holes 122C pushes the guide surface 172C. Thus, the hook heads 172B move toward the geometric center C of the hook heads 172B, such that the resilient supports 172A are inserted into the through holes 122C, thereby finishing the assembly of the circuit board 122. Therefore, in the lighting apparatus 100 according to this embodiment, the circuit board 122 and the base 110 may be assembled easily, so as to reduce the cost and shorten the working hours.

It should be noted that, the present invention does not limit that the locking elements 170 are applied in the lighting apparatus 100 having the recesses 112C and the encapsulant 160. In other embodiments that are not shown, the locking elements 170 may also be applied on the lighting apparatus having an internal space formed by the base and the light transmissive lamp shade filled with the encapsulant. Since the locking elements 170 may lock the circuit board on the base, the circuit board will not float on the encapsulant in the manufacturing process. Therefore, the manufacturing yield of the lighting apparatus will not be reduced.

In view of the above, in the lighting apparatus according to the embodiments of the present invention, the conducting wires extend from above the bottom board of the base to the recesses through the first through holes, and extend from the recesses to above the bottom board through the second through holes. When the conducting wires are pulled by an external force, the recesses may bear the pulling force from the conducting wires, so as to prevent the conducting wires from dropping off from the light emitting unit. Thus, even if the conducting wires are pulled by an external force, the lighting apparatus may still operate normally.

In addition, in the lighting apparatus according to the embodiments of the present invention, since the encapsulant is merely located in the recesses and between the first fitting portion and the second fitting portion, the lighting apparatus may have a light weight and a low cost, and no air bubbles will appear in the encapsulant to affect the light shape and lighting efficiency of the lighting apparatus.

Furthermore, in the lighting apparatus according to the embodiments of the present invention, since the circuit board may be assembled onto the base easily by using the locking element, the circuit board will not float on the encapsulant when filling the encapsulant. Thus, the lighting apparatus may have a high manufacturing yield and manufacturing efficiency.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A lighting apparatus, comprising:

a base, comprising:

a bottom board, comprising:

a first surface;

a second surface, opposite to the first surface;

a recess, located at the second surface, wherein the recess comprises a first end and a second end opposite to the first end;

a first through hole, located at the first end of the recess and passing through the bottom board; and a second through hole, located at the second end of the recess and passing through the bottom board; and a side frame, disposed on the first surface, wherein the first through hole and the second through hole are respectively inside and outside the side frame;

a light emitting unit, disposed on the first surface and inside the side frame; and a conducting wire, wherein one end of the conducting wire is electrically connected to the light emitting unit, the conducting wire extends from the first surface to the first end of the recess through the first through hole, extends from the first end to the second end, and extends from the second end to an outer side of the first surface through the second through hole.

2. The lighting apparatus according to claim 1, further comprising an encapsulant, filled in the recess and encapsulating a part of the conducting wire in the recess.

3. The lighting apparatus according to claim 1, wherein the bottom board further comprises a hook located in the recess and at one side of the conducting wire, and a hook head of the hook is located at a top of the recess, so as to hook the conducting wire.

4. The lighting apparatus according to claim 1, wherein the light emitting unit comprises:

a circuit board, disposed on the first surface and inside the side frame, wherein the end of the conducting wire is connected to the circuit board; and a light-emitting diode (LED), disposed on the circuit board.

5. The lighting apparatus according to claim 1, further comprising a light transmissive lamp shade, disposed on the side frame, and covering the light emitting unit, wherein the light transmissive lamp shade comprises a light exit surface facing away from the light emitting unit, and the light exit surface comprises a plurality of optical structures for changing an emergence direction of light emitted from the light emitting unit.

6. The lighting apparatus according to claim 5, wherein the side frame comprises a first fitting portion located at one end of the side frame far away from the bottom board, the light transmissive lamp shade comprises a second fitting portion located at one end of the light transmissive lamp shade far away from the light exit surface, and the first fitting portion and the second fitting portion fit with each other.

7. The lighting apparatus according to claim 6, wherein the first fitting portion is an annular protrusion, and the second fitting portion is an annular depression.

8. The lighting apparatus according to claim 6, wherein the first fitting portion is an annular depression, and the second fitting portion is an annular protrusion.

9. The lighting apparatus according to claim 6, further comprising an encapsulant disposed between the first fitting portion and the second fitting portion.

* * * * *